US007380505B1

(12) United States Patent
Shiery

(10) Patent No.: US 7,380,505 B1
(45) Date of Patent: Jun. 3, 2008

(54) MUZZLELOADING FIREARM PROJECTILE

(76) Inventor: Jeffrey C. Shiery, 4199 D Dr. South, East Leroy, MI (US) 49051

( * ) Notice: Subject to any disclaimer, the term of this patent is extended or adjusted under 35 U.S.C. 154(b) by 0 days.

(21) Appl. No.: 11/646,959

(22) Filed: Dec. 28, 2006

Related U.S. Application Data

(63) Continuation-in-part of application No. 11/477,843, filed on Jun. 29, 2006, now abandoned.

(51) Int. Cl.
*F42B 14/00* (2006.01)

(52) U.S. Cl. ..... 102/524; 102/501; 102/526

(58) Field of Classification Search ..... 102/501, 102/507, 508, 509, 510, 524, 526, 527, 439, 102/525; 42/51; 89/1.3
See application file for complete search history.

(56) References Cited

U.S. PATENT DOCUMENTS

| | | | | | |
|---|---|---|---|---|---|
| 15,999 | A | | 10/1856 | Read | |
| 33,100 | A | | 8/1861 | Parrott | |
| 40,153 | A | * | 10/1863 | Billings | 102/525 |
| 405,690 | A | * | 6/1889 | Ball | 102/520 |
| 816,577 | A | * | 4/1906 | Haase | 102/517 |
| 2,911,911 | A | * | 11/1959 | White | 102/439 |
| 4,436,035 | A | * | 3/1984 | Strandli | 102/364 |
| 4,610,205 | A | | 9/1986 | Bentley | |
| 4,777,883 | A | * | 10/1988 | Chevich | 102/503 |
| 5,149,913 | A | * | 9/1992 | Arakaki | 102/506 |
| 5,458,064 | A | | 10/1995 | Kearns | |
| 5,621,187 | A | * | 4/1997 | Kearns | 102/520 |
| 7,207,275 | B1 | | 4/2007 | Oertwig | |
| 7,219,607 | B2 | * | 5/2007 | Oertwig | 102/501 |
| 2005/0034626 | A1 | * | 2/2005 | Sanborn | 102/510 |
| 2006/0027130 | A1 | * | 2/2006 | Parker | 102/517 |

* cited by examiner

*Primary Examiner*—James S Bergin
(74) *Attorney, Agent, or Firm*—Flynn, Thiel, Boutell & Tanis, P.C.

(57) ABSTRACT

A muzzle loading firearm projectile is disclosed that is composed of a multi diameter, hollow base solid copper bullet, the rear cavity filled with a material of low-density, and a gas pressure seal that separates the bullet from the powder charge. The majority of the bullet shank has a diameter less than the bore diameter of the firearm barrel to allow for ease of loading and alignment of the barrel and bullet axis; a narrow ring of material larger than the barrel bore diameter but less than the groove diameter is located at the junction of the bullet shank and nose profile that centers the bullet in the barrel and positively positions the bullet over the powder charge regardless of orientation of the firearm. The low-density material filling the rear cavity of the bullet acts as an expansion medium when impacted by the rear gas seal during the firing process causing the hollow shank of the bullet to expand and lock into the barrel rifling.

21 Claims, 3 Drawing Sheets

FIG. 2
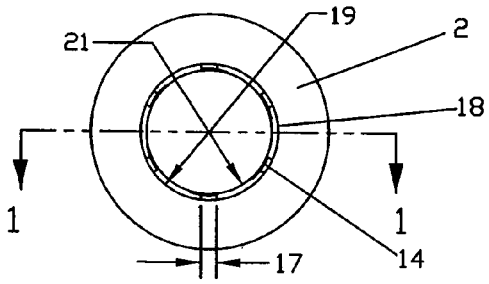
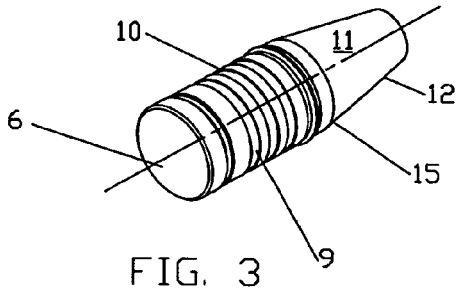
FIG. 3
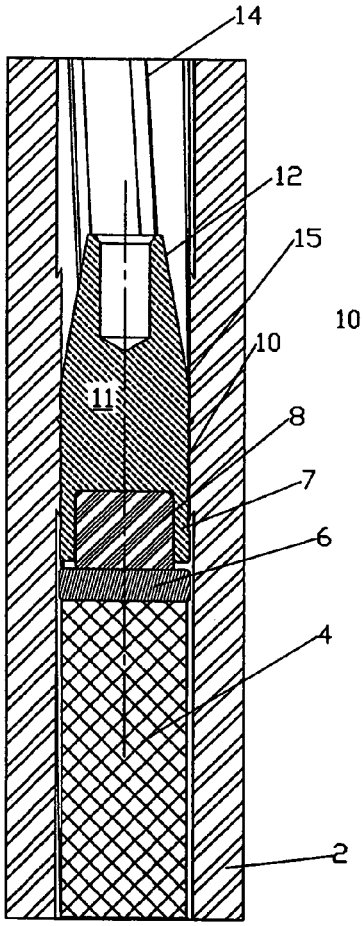
FIG. 1
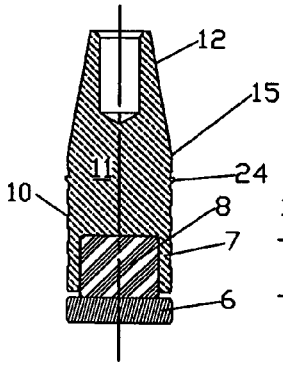
FIG. 4
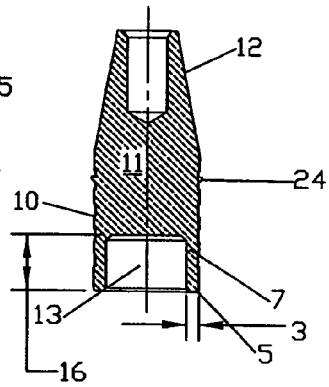
FIG. 4a
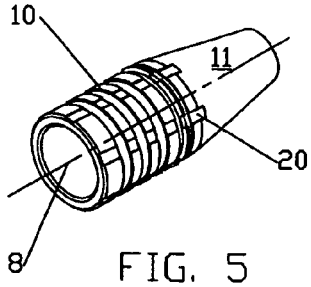
FIG. 5

MUZZLELOADING FIREARM PROJECTILE

CROSS-REFERENCE TO RELATED APPLICATION

This application is a continuation-in-part of U.S. application Ser. No. 11/477,843, filed Jun. 29, 2006, now abandoned.

FIELD OF THE INVENTION

This invention relates to firearm projectiles, and, more specifically, to a solid copper or combination polymer/brass full bore projectile for muzzle loading firearms.

BACKGROUND OF THE INVENTION

The principles that define usability and contribute to consistent accuracy of muzzle loading firearm projectiles have not changed much since the late $16^{th}$ century. Firearm and projectile designers have worked continuously to minimize the loading efforts of muzzle loading projectiles while at the same time attempting to develop ideas that would consistently assure an effective gas seal and engagement of the projectile with the rifling of the firearms barrel. If the projectile loading efforts are too high or inconsistent the projectile will not be loaded in contact with the powder charge leading to inconsistent load points and possibly dangerous air gaps between the projectile and the powder charge resulting in unacceptable accuracy. If upon ignition of the powder charge the projectile does not seal the propellant gases or engage with the barrel rifling, rotary motion will not be imparted to the projectile and it will not stabilize in flight, also causing unacceptable accuracy. Over the course of the last three centuries, four major types of projectiles have evolved to accommodate the projectile requirements of muzzle loading firearms covering the spectrum from hand held firearm to the mid $19^{th}$ century cannons.

The oldest form of muzzle loading projectiles are the all lead round ball or conical bullet wrapped in a material that fills the space between the bore and groove diameters of the firearm barrel. The wrapper serves three purposes namely: it fills the void between the bore size bullet and the groove diameter of the barrel creating an effective gas seal; it also is the mechanism that engages the projectile with the barrel rifling to create the rotary motion necessary to stabilize the projectile and create a predictable flight trajectory; and it also prevents movement of the projectile once seated on the powder charge regardless of barrel position. A number of different materials have been utilized for this wrapper or gas seal including cloth, paper, or more recently plastic. This style of projectile was used extensively for hunting, target and military applications through the $19^{th}$ century.

The most recent refinement of the wrapped or encased bullet was developed and refined over the last 30 years and is defined as a sabot. The sabot is basically a plastic tube with a partition in the middle that separates the bullet from the powder charge. The portion of the sabot towards the powder charge is cupped with thin exterior walls that act as a gas seal when the powder charge is ignited. The walls of the cylinder that encase the bullet are thicker than the cloth or paper patch and are slit in multiple locations through the area that contains the bullet to allow the sabot to release and fall away from the bullet once the two have exited the barrel muzzle. The increased wall thickness of the sabot allows for bullets up to two caliber sizes smaller than a full bore projectile that would normally be used. An example of this would be a sabot with an inside diameter of 44 caliber or 0.429 inches in diameter and an outside diameter of 50 caliber or 0.510 inches in diameter allowing a 44 caliber bullet to be fired in a 50 caliber firearm. Sabots have been developed for 54, 50, and 45 caliber firearms with 50 being the most popular. The ability to fire sub bore projectiles accommodates a number of disadvantages that exist with the current full-bore projectiles or bullets. The major advantage that the sub caliber bullet has over the full-bore projectile is that significantly higher velocities can be achieved with a common powder charge. The sub bore bullets will typically be much lighter with better ballistic efficiencies than the full bore projectile. The higher velocities and better ballistic profile contribute to significant flatter trajectories and similar impact energies at normal hunting distances.

The trend in recent years has been to use the sabot technology to drive light bullets of heavy construction to velocities approaching those typified by center fire rifles. The features of the sabot that allow the use of light sub bore bullets also contribute to its limitations. As the projectile velocities approach 2,000 fps, the propellant pressures necessary to accelerate the projectile to this velocity exceed the physical limitations of the plastics that the sabots are composed of. In addition, this problem is exacerbated as the environmental temperatures exceed 75° F. degrees and the elongation of the plastic increases with the increase in temperature. As the physical properties of the plastics are exceeded, accuracy deteriorates quickly due to the plastic of the sabot coating the inside of the barrels and the disintegration of the pressure cup at the base of the sabot. Sabots are often hard to load due to the number of variables that must be accounted for between the sabot, bullet, and barrel and associated pressures. Another deficiency of sabots is that it is often necessary to swab the bore of the firearm between firing sequences with a damp and then dry wad to prevent the build up of the expended powder residue from the previous firing. If the barrel is not swabbed between shots, accuracy will deteriorate quickly due to the build up of residual matter left from ignition of the previous powder charge altering the frictional characteristics between the sabot and the firearm barrel. An additional draw back to the sabot style of projectile is that it is not legal for use for big game hunting of species larger than deer in most of the western United States.

In the early to mid $19^{th}$ century, considerable development work was focused on the development of a full bore elongated lead bullet that could be easily loaded but would expand to seal and engage the barrel rifling. The designs typically were composed of an elongated lead bullet with multiple grooves and hollow base. The grooves may or may not have been filled with a lubricant the purpose of which was to allow for ease of loading and an attempt to keep the residual powder fouling build up soft from the previous firing sequence. The only major difference between the mid $19^{th}$ century and present day bullet designs of this style is that one of the major diameters of the circumferential grooves of the bullet is larger than the bore diameter of the barrel. The modern designers have increased the ring diameter to prevent the bullet from shifting within the barrel regardless of barrel position. The purpose of the hollow skirt is to act as a gas seal when the powder charge is ignited expanded to the barrel groove diameter and a mechanism to impart spin to the bullet as it passes through the barrel. The all lead full bore projectile's are typically heavy for caliber due to their composition which limits their effective hunting range to 125 yards or less. These projectiles also require that the firearms barrel be swabbed between firings to ensure loading efforts do not become excessive due to fowling building up from the previous ignition sequence. This type of projectile or bullet will only function correctly if composed of lead. Currently, within the United States, there is a movement to ban the use of lead in firearm projectiles. Legislation to prevent the use of lead for waterfowl hunting was successfully passed in the United States in the late $20^{th}$ century and is presently being pursued for firearms in the regions of California inhabited by Condors.

The final type of major projectile developed for muzzle loading firearms is a full bore thin skirted bullet. Two variations of this style of projectile have evolved, the first of which was developed in the mid $19^{th}$ century for use in the civil war cannon. Examples of this design can be reviewed in U.S. Pat. No. 15,999 issued to John B. Reed and U.S. Pat. No. 33,100 issued to R. P. Parrott. The body of the projectiles was typically composed of cast iron or steel with a hollow thin iron or brass/bronze skirt secondarily attached. The outside diameter of the projectile is slightly smaller than the bore diameter of the barrel it is to be fired in. Upon detonation of the powder charge, the hollow skirt of the projectile expands to act as a gas seal and engage the rifling of the barrel imparting rotary motion and stabilizing the projectile in flight. The second variation of this idea can be viewed in U.S. Pat. No. 5,458,064 issued to R. M. Kerns. This design was developed for modern muzzle loading firearms and uses a thin plastic skirt attached to the base of the bullet by a small extruded stub at the posterior of the bullet. The outside of the diameter of the bullet is slightly smaller than the bore diameter of the barrel to allow for ease of loading. Upon ignition of the powder charge, the plastic skirt expands and acts as a gas seal. The bullet is composed of a soft lead which upon detonation of the powder charge expands to engage the rifling of the barrel to impart rotary motion to the projectile. Due to the number of variables involved between the bullet and the barrel, it is difficult to depend on the predictability of this style of bullet to expand or obturate to the groove diameter of the barrel to ensure that rotary motion is imparted. Temperature, pressure, and rate of ignition of the powder charge all play a role of differing levels depending on the environmental conditions at the time. Additionally, the plastic skirt for this style of projectile will have the same limitations from a velocity perspective as that seen with the sabot style. The sabot and the gas check on the Kerns style bullet both can create small air pockets between the projectile and powder charge, which can retard the rate of ignition of the powder ignition leading to inconsistent projectile velocities and accuracy.

It is therefore a primary object of the present invention to provide a projectile having in combination a multi diameter hollow base solid copper bullet filled with an expansion plug so that when utilized in conjunction with a gas check member, the bullet has the ability under normal muzzle loading firearm propellant pressures to expand the shank portion of the bullet filled by the expansion plug to engage the barrel rifling and impart rotary motion to the bullet.

It is also an object of the present invention to provide a projectile with a multi diameter shank bullet so that the majority of the bullet can be easily loaded within the bore of the intended firearm but has the ability to self center when the projectile is fully loaded within the bore of the firearm.

SUMMARY OF THE INVENTION

The objects and purposes of the invention are met by providing a muzzle loading firearm projectile composed of a solid copper multi diameter, hollow base bullet, the rear cavity of which is filled with an expansion plug composed of a low density malleable material used in conjunction with a separate gas pressure seal or check member also composed of a malleable material. The majority of the cylindrical portion of the bullet or shank is slightly smaller in diameter than the bore of the barrel with the exception of a thin web of material located at the transition area between the shank and nose of the bullet that is larger than the bore diameter but smaller than the groove diameter of the firearm barrel. The sub bore portion of the bullet allows for the majority of the bullet to be easily loaded within the barrel and assures reasonable alignment of the shank of the bullet and barrel axis. The ring of material larger than the bore diameter of the barrel deforms to or conforms to the rifling profile of the barrel upon being forced into the barrel to thereby center the nose and top portion of the shank of the projectile with the bore of the firearm. Additionally, the ring also creates interference between the bore of the barrel and the bullet to restrain the projectile in place regardless of firearm positioning.

BRIEF DESCRIPTION OF THE DRAWINGS

Other objects and purposes of this invention will be apparent to persons acquainted with bullet technology of this general type upon regarding the following specification and inspection of the accompanying drawings, in which:

FIG. 1 is an axial sectional view of the present invention in the loaded position staged to be fired within the bore of a firearm barrel;

FIG. 2 is an end view of the firearm barrel;

FIG. 3 is an isometric view of the present invention including the gas check member;

FIG. 4 is an axial sectional view of the present invention applied to a hollow point bullet including a gas check member;

FIG. 4*a* is an axial sectional view of the bullet per se;

FIG. 5 is an isometric view of the present invention after being fired from a firearm barrel;

DETAILED DESCRIPTION OF THE INVENTION

Figure 6:
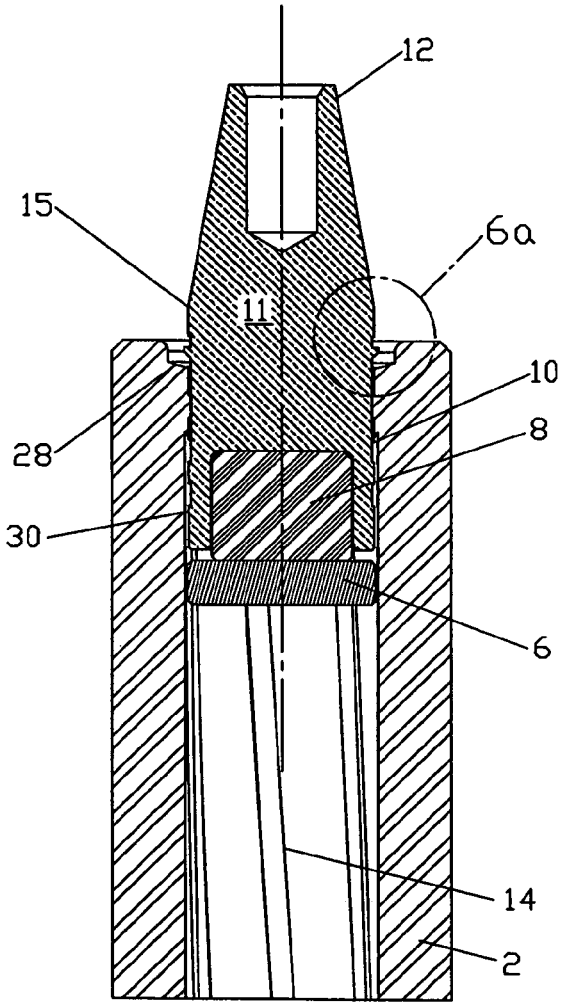
FIG. 6 is an axial sectional view of the present invention staged to be loaded into a firearm barrel.

Referring now to the drawings, there is shown in FIG. 1 a loaded breach assembly composed of a rifled firearm barrel 2, a projectile 15 of this invention, a gas check member 6, and a powder charge 4. The caliber of the firearm barrel 2 may be any one of a number of those popular with the muzzle loading firearm industry. The bore of the barrel is rifled with a series of equally spaced raised spiral grooves 14 and lands 18 that transcend the length of the barrel. The bore diameter is defined as the minor diameter of the rifling grooves 14, is shown in FIG. 2 as number 21. The groove diameter is defined by the rifling lands 18 is defined as number 19. The differential between the rifling bore diameter 21 and the groove diameter 19 is typically between 0.005 and 0.012 inches. The purpose of the rifling is to impart rotary motion to the projectile as it is propelled down the length of the barrel 2 by the propellant gases created from igniting the powder charge 4 creating gyroscopic stability resulting in an accurate and predictable flight path of the projectile 15. The projectile 15 is composed of a copper bullet 11 and an expansion plug 8.

Figure 6A:
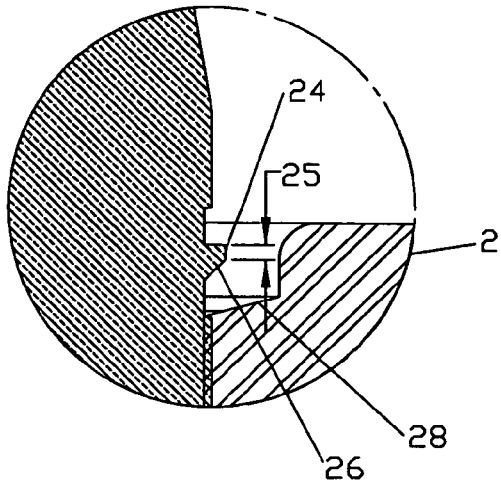
FIG. 6*a* is an enlarged view of the encircled region of FIG. 6 to highlight the centering ring of the present invention.

The bullet 11 is shown in FIG. 4*a* and consists of a nose portion 12, a centering ring 24 and a cylindrical shank portion 10. The shank 10 terminates in a trailing edge 5 with a wall or skirt 7 surrounding a hollow cylindrical cavity 13. The centering ring 24 is located at the junction of the nose portion 12 and the cylindrical shank portion 10 of the bullet 11. In the preferred embodiment, the diameter of the cylindrical shank 10 measures 0.0001 to 0.003 inches smaller than the bore diameter 21 of the caliber that the firearm the bullet 11 is to be used in. For example, if the firearm barrel is 50 caliber the minimum diameter of the bore diameter 21 for this caliber is 0.5000 of an inch and the cylindrical shank diameter 10 of the present of invention should measure at a maximum 0.4999 of inch to allow the cylindrical shank 10 portion of the bullet 11 to be inserted into the barrel 2 with no interference between the bore diameter 21 and cylindrical shank 10 diameter. The smaller the differential between the cylindrical shank 10 diameter and the bore diameter 21 without creating an interference condition the closer the barrel 2 and bullet 11 axis align and the better the probability the bullet will be rotated about its true axis. The centering ring 24 of the bullet 11 includes an angled face 26 (see FIG. 6*a*) so that when the angled face is in contact with the barrel crown 28, it effects the centering of the nose portion 12 of the bullet 11 within the barrel 2. The outside diameter of the centering ring 24 is larger in diameter than the groove diameter 21 but smaller in diameter than the land diameter 19. Referring once again to the 50 caliber example, the outside diameter of the centering ring 24 will be in the preferred embodiment, in the range of 0.501 to 0.507 inches in diameter and 0.001 to 0.015 inches in thickness 25. The centering ring 24 creates an interference surface with the bore diameter 21 of the barrel 2 ensuring that the projectile stays in the loaded position and centered within the bore prior to ignition of the powder charge 4. It has been found through experimentation that the force to drive the bullet 11 into the barrel 2 impressing the rifling groove 14 profile into the centering ring 24 becomes excessive when the thickness 25 of the centering ring 24 exceeds 0.025 inches.

The cylindrical shank 10 portion of the bullet and its corresponding wall or skirt 7 have been refined through design and experimentation to expand at muzzle loading firearm pressures ranging from 10,000 psi to 50,000 psi. In the preferred embodiment of the design the wall or skirt 7 of the cylindrical shank 10 will be from 0.040 to 0.065 inches thick at its thickest section 3 with an average of 0.050 inches preferred. An average thickness 3 of the wall or skirt 7 of 0.050 inches has been found through experimentation to meet the design intent of the subject invention for muzzle loading firearms of 50, 45 and 44 caliber. The ability of the wall or skirt 7 to expand is a function of the internal pressures generated by the ignition of the propellant 4, the width of the rifling grooves 17, and the resistance of the bullet material to expand and conform to the bore 21 and land diameters 19 of the firearm barrel. The preferred depth 16 of the hollow cylindrical cavity 13 has been found to be from 0.200 to 0.400 inches deep with 0.225 inches preferred. An average depth 16 of the hollow cylindrical cavity 13 of 0.225 inches has been found to work well across the pressure ranges encountered with muzzle loading firearms of 50, 45, and 44 calibers.

The composition of the bullet 11 can be copper or copper alloys with minor quantities of non-copper elements, such as zinc, lead, iron, magnesium, phosphorus, silver, or cobalt. The preferred composition and heat treat of the bullet 11 material is one of the 99.9% oxygen free coppers commercially available such as CDA#C10200 or C101. In the preferred embodiment, the copper composing the bullet 11 will be heat treated to the annealed condition by heating the bullet 11 to a temperature of ranging from 800 to 950 degrees F. At the conclusion of the heat treat operation, the annealed copper bullet will have a hardness range measured on the Rockwell "F" scale ranging from 25 to 45 with a hardness of 35 or less being preferred.

The expansion plug 8 in the preferred embodiment is composed of a wool felt with a wool fiber content greater than 90%, a hardness durometer from 35 to 80 shore A, a specific gravity from 16-32 and a tensile strength from 300-600 psi. The felt most preferred for the expansion plug 8 has a 95% wool fiber content, a hardness durometer of 55 shore A, a specific gravity of 24, and tensile strength of 500 psi. Hard wool felt is the preferred material for this application due to the stability of the physical properties of the material over a wide range of temperatures (−80° F. to 200° F.). The expansion plug 8 is manufactured to be 0.005 to 0.025 inches larger in diameter than the hollow cylindrical cavity, 13 of the bullet 11 that it is to be used in. For example if the hollow cylindrical cavity 13 is 0.313 inches in diameter the corresponding expansion plug will be range from 0.318 to 0.330 inches in diameter to assure a press or interference fit into the hollow cylindrical cavity 13. The purpose of the interference fit of the expansion plug 8 within the hollow cylindrical base 13 is to minimize air gaps and to ensure consistent expansion and conformance of the bullet wall 7 into the groove 21 and land 19 diameters of the barrel 2. The expansion plug 8 could be manufactured from malleable materials other than felt, such as rubber, plastic, cork, or paper. However, it has been determined that the physical properties of felt change minimally over the temperature ranges encountered in the shooting sport industry, which can range from −40° F. in the northern climates to 130° F. found in the equatorial climates. Additionally it has been determined that the length of the expansion plug 8 should be from 0.005 to 0.075 inches longer than the depth of the hollow cylindrical cavity 13 with 0.050 inches preferred. Extending the length of the expansion plug beyond the hollow cylindrical cavity 13 has been found to assist with consistent expansion of the cylindrical shank 10 to the barrel rifling bore 21 and groove 19 profile of the barrel 2.

The gas check member 6 is not physically attached to the bullet but is, nevertheless, a critical element of the present invention. The gas check member 6 must have physical material properties that allow it to be capable of conforming to the posterior of the bullet and the rifling profile of the bore to effectively seal the propellant gases at temperatures from −40° F. to 130° F. Should the propellant gases escape around the outside of the gas check member 6 inconsistent muzzle velocities and projectile 15 inaccuracy will result. In the preferred embodiment, the outside diameter of the gas check member 6 fits the bore of the intended firearm snugly and is composed of a felt material approximately 0.100 inches thick. Felt is the preferred material due to its stable physical properties over a wide temperature range and its ability to conform easily to the bore of the firearm and the posterior of the projectile 15 during ignition of the powder charge 4. This type of gas check member is also readily available at most firearm retail outlets. The gas check member 6 could also be manufactured from materials other than felt such as plastic, or cardboard.

Referring now to FIG. 1, upon ignition of the powder charge 4 the propellant gases are sealed behind the gas check member 6 driving it into the expansion plug 8 in the cavity 13 with sufficient force to compress the expansion plug and cause the wall 7 of the cylindrical base 10 to expand, engage, and conform to the bore 21 and groove 19 diameters of the barrel 2, effectively aligning the barrel 2 and the axis of the projectile 15. As the projectile 15 transitions the length of the barrel, rotary motion is imparted to the projectile 15 stabilizing it about its axis resulting in an accurate and predictable flight path. An example of a fired projectile 15 can be seen in FIG. 5 with the cylindrical shank 10 portion of the bullet 11 expanded and having the rifling groove 14 pattern impressed into the exterior surface of the shank 10. The cylindrical shank 10 portion of the bullet has a series of annular grooves 9 that are cut into the surface to reduce the amount of force required to expand the wall 7 of the cylindrical base 10 as well as acting as a depository for the application of a low friction grease or lubricant that will reduce the friction between the bullet 11 and the barrel 2 and retard the hardening of the products from the powder ignition of the previous firing sequence.

ALTERNATE CONSTRUCTIONS

Figure 7:
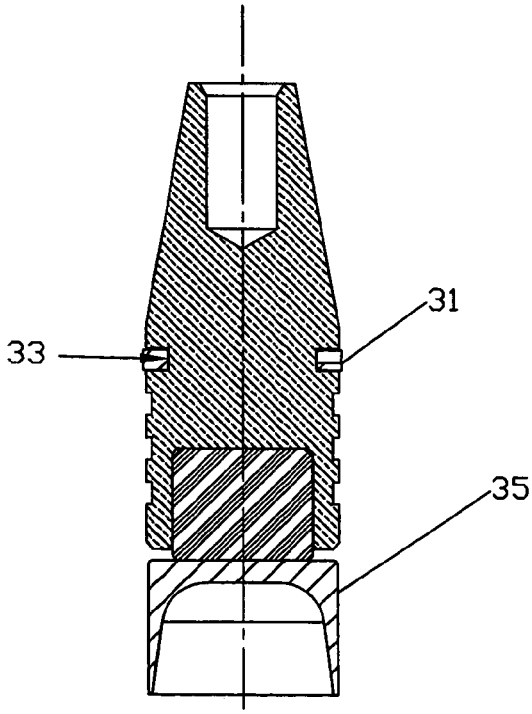
FIG. 7 is an axial sectional view of a first alternate construction of a bullet embodying the invention with a secondary locating or centering ring.

Additional experimentation yielded an alternate construction of the above design that can be viewed in FIG. 7. The alternate construction deviates from the original design in that the bullet 11 has an additional groove defined as a retaining ring groove 33 in place of the centering ring 24. The retaining ring groove 33 contains a locating ring 31 that serves the same function as the centering ring 24 in that it centers the bullet 11 within the barrel 2 and it retains the loaded bullet 11 in position regardless of barrel 2 position. The locating ring 31 can be composed of any number of plastic type materials such as nylon, acetyl, with Teflon being the preferred material. The locating ring 31 is split at a single location 34 to allow ease of assembly of the locating ring 31 to the bullet 11 and to allow the locating ring 31 to conform to the inside profile of the barrel 2 upon being pressed into the barrel 2. Also shown in FIG. 7 is an alternate style gas check 35 that can be used with either bullet style. This style of gas check 35 is typically molded from plastic but could feasibly be machined as well.

Figure 8:
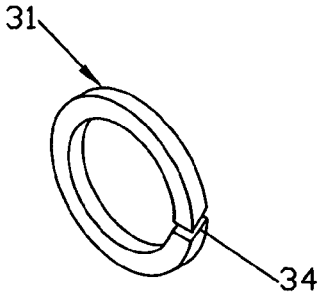
FIG. 8 is an isometric view of the split locating or centering ring.
Figure 9:
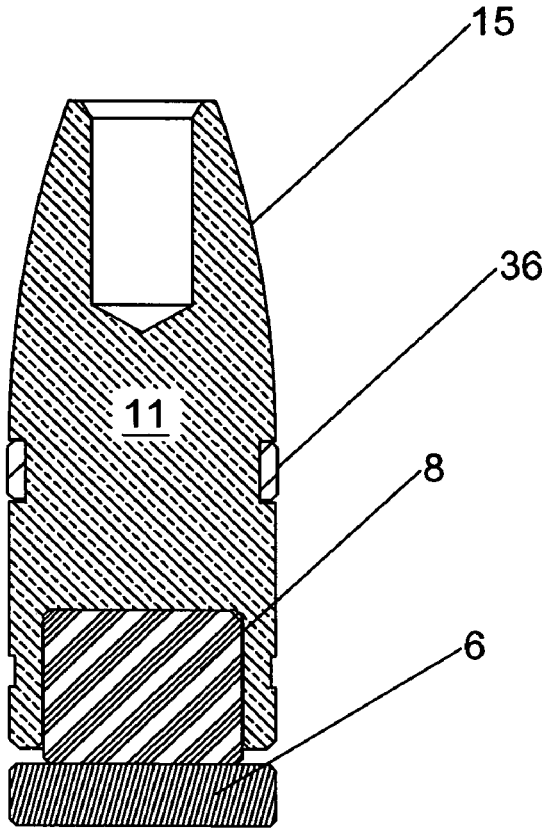
FIG. 9 is an axial sectional view of a second alternate construction of a bullet embodying the invention with a circumferentially continuous locating or centering ring.
Figure 10:
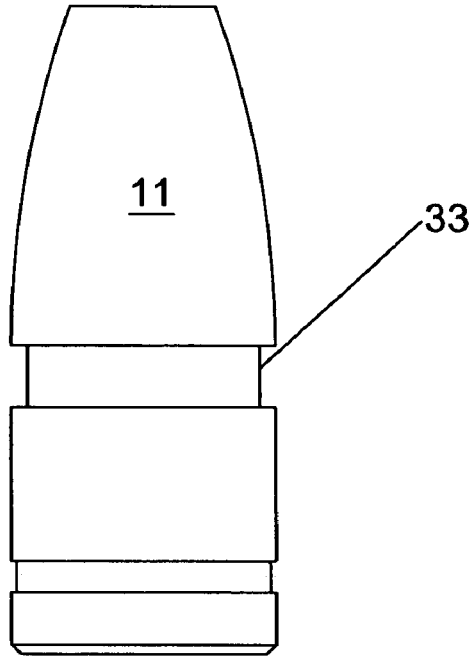
FIG. 10 is a side view of the bullet minus the locating or centering ring.
Figure 11:
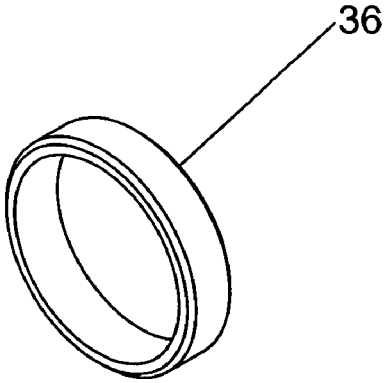
FIG. 11 is an isometric view of the circumferentially continuous locating or centering ring.

A further alternate construction similar to the locating or centering ring 31 shown in FIGS. 7 and 8 is illustrated in FIGS. 9-11. Here, the ring 36 is made of a polymer and is circumferentially continuous. The circumferentially continuous polymer centering ring 36 composes the best features of the centering ring 24 and the locating ring 31 in that it allows the projectile to be loaded easily, centers the projectile within the rifle barrel 2, adequately restrains the bullet 11 in position over the powder charge 4, and accommodates the tolerance range of the present rifle barrel manufactures rifling profiles.

The rings 31 and 36 tightly fit in their respective retaining groove 33 formed into the mating bullet 11. In the preferred embodiment, the rings 31 and 36 will be from 0.050 to 0.150 of an inch wide and from 0.020 to 0.050 of an inch thick, with the preferred embodiment being 0.095 of an inch wide and 0.032 of an inch thick optimal. In the preferred embodiment the rings 31 and 36 will be composed of Teflon with any polymer with similar composition and physical properties being acceptable.

The advantages that the polymer rings 31 and 36 have over the metal centering ring 24 is that the manufacturing tolerances do not have to be as restrictive with the polymer rings 31 and 36 and the corresponding force to deform the rings as the projectile is loaded into the rifle barrel 8 is more consistent over a broader range of rifle manufacturer's rifling tolerances. As stated above, the purpose of the circumferentially continuous ring 36, the integrated metal ring 21, or split ring 34 is to center the projectile within the barrel and retain the projectile in place with sufficient force to allow upon ignition, for the powder charge to achieve sufficient pressure to expand the bullet skirt into the rifling of the barrel that the projectile is being fired from.

The circumferentially continuous polymer centering ring 36 can be manufactured as a separate machined or molded component that is expanded to slip over the major diameter of the bullet but contracts to fit tightly within the mating groove. To accommodate large production volumes the polymer ring 36 could be injection molded to the bullet with dedicated tooling. Regardless of manufacturing technique the circumferentially continuous centering ring 36 needs to tightly fit the retaining ring groove 33 to ensure that the design intent is met.

The material of choice for the circumferentially continuous ring is TFE (Teflon) but any number of polymers with similar physical properties would be acceptable. In the preferred embodiments of the rings 31 and 36, the outer diameter of the rings, when attached to the projectile, is from 0.002 to 0.004 inches larger in diameter than the major diameter of the projectile. In the preferred embodiments of the polymer rings 31 and 36, when assembled to the mating bullet, the respective diameters will be of sufficient size to fit the area available between the outside diameter of the bullet and the open areas between the rifling 18. The calculated amount of radial exposure of the rings, when assembled to the mating bullet 11, is slightly less than the calculated area of the sum of the available cross sectional area of the barrel rifling that the projectile is to be fired within. It has been found that this level of interference between the projectile 15 and the rifled barrel 8 is sufficient to allow the projectile 15 to be easily loaded but ensures that the detonation pressures of the powder charge 4 will be allowed to build to a sufficient level upon ignition of the powder charge 4 to ensure that the bullet skirt 7 is expanded to engage the barrel rifling 14.

The composition of the bullet 11 can be expanded to include free machining brass defined as UNS 36000 brass heat treated to an annealed condition with a hardness of Rockwell F of 95 or less. It has been determined that 36000 brass with a hardness greater than Rockwell F of 95 will meet design intent but not function to the level of performance or consistency that either C101 copper or UNS 36000 brass will when softened to a Rockwell F hardness of less than 95.

Although particular preferred embodiments of the invention have been disclosed in detail for illustrative purposes it will be recognized that variations or modifications of the disclosed apparatus, including the rearrangement of parts, lie with the scope of the present invention.

What is claimed is:

1. A muzzleloading firearm projectile for use with a firearm having a barrel with longitudinally extending rifling on an inside surface thereof, said projectile comprising:

a projectile body having at one end a tapered nose portion and at an opposite end a cylindrical shank, said projectile body being made of a copper or a copper alloy;

a cylindrical skirt integral with said projectile body and oriented at an end of said cylindrical shank remote from said tapered nose portion coextensive with and extending longitudinally from said shank a finite distance to define a cavity having finite dimensions of depth and diameter, said skirt having a wall thickness configured to enable said cylindrical skirt to expand in diameter in response to an explosive discharge of powder used to propel said projectile body nose first from a barrel of the firearm from which said projectile body is being fired;

an expansion plug filling said cavity and having its diameter dimension conforming to the diameter dimension of said cavity when received in said cavity and a length dimension that is at least one of equal to and greater than the depth dimension of said cavity, said expansion plug being made of a malleable material consisting of one of the group of wool felt, rubber, plastic, cork and paper and being configured to be compacted into said cavity in response to the explosive discharge of powder used to propel said projectile body nose first from the barrel of the firearm from which said projectile body is being fired to effect the expansion in diameter of said cylindrical skirt and an engagement of an outer surface of said cylindrical skirt with the rifling on the barrel; and a guidance ring provided on said cylindrical shank of said projectile body and extending radially outwardly of said projectile body at a location adjacent a juncture between said tapered nose portion and said cylindrical shank, said guidance ring being configured to have an outer diameter greater than a diameter of said cylindrical shank and a diameter of a rifling bore diameter of the firearm from which said projectile body is to be fired but less than a diameter of a groove diameter of the aforesaid rifling of the barrel, said guidance ring having a malleable characteristic to enable it to conform to the rifling on the barrel in response to being inserted into the barrel during a muzzleloading procedure.

2. The muzzleloading firearm projectile according to claim 1, wherein said guidance ring has an annual beveled surface facing toward said end of said projectile body whereat said skirt is located.

3. The muzzleloading firearm projectile according to claim 1, wherein said guidance ring is integral with said projectile body.

4. The muzzleloading firearm projectile according to claim 1, wherein said projectile body includes an annual cavity at said juncture and into which is received a separate guidance ring component.

5. The muzzleloading firearm projectile according to claim 4, wherein said separate guidance ring component is made of a polymer.

6. The muzzleloading firearm projectile according to claim 4, wherein said guidance ring is circumferentially continuous.

7. The muzzleloading firearm projectile according to claim 4, wherein said guidance ring is a split ring.

8. The muzzleloading firearm projectile according to claim 1, wherein said expansion plug has a length that is greater than the depth of said cavity.

9. The muzzleloading firearm projectile according to claim 1, wherein said projectile body is made of a free machining brass.

10. The muzzleloading firearm projectile according to claim 9, wherein said free machining brass is a UNS 36000 brass that has been heat treated to an annealed condition with a hardness of Rockwell F of 95 or less.

11. The muzzleloading firearm projectile according to claim 1, wherein said projectile body is made of a copper or copper alloys having minor quantities of one or more non-copper components.

12. The muzzleloading firearm projectile according to claim 1, wherein said projectile body is made of a 99.9% oxygen free copper, namely, one of CDA#C10200 or C101 copper.

13. The muzzleloading firearm projectile according to claim 1, wherein said expansion plug is made of a wool felt having a wool fiber content greater than 90%, a hardness durometer ranging from 35 to 80 shore A, a specific gravity ranging between 16 and 32 and a tensile strength ranging between 300 and 600 psi.

14. The muzzleloading firearm projectile according to claim 13, wherein said expansion plug is made of a wool felt having a wool fiber content of 95%, a hardness durometer of 55 shore A, a specific gravity of 24 and a tensile strength of 500 psi.

15. The muzzleloading firearm projectile according to claim 1, wherein said expansion plug has a diameter, prior to insertion into said cavity, that is in the range of 0.005 to 0.025 inches larger than the diameter of said cavity.

16. The muzzleloading firearm projectile according to claim 1, wherein said expansion plug has a length that is in the range of 0.005 to 0.075 inches longer than the depth of said cavity.

17. The muzzleloading firearm projectile according to claim 16, wherein said expansion plug has a length that is 0.050 inches longer than the depth of said cavity.

18. The muzzleloading firearm projectile according to claim 1, wherein said cylindrical shank has on an outer surface thereof plural longitudinally spaced annular grooves therein oriented in planes that are perpendicular to said longitudinal axis.

19. The muzzleloading firearm projectile according to claim 1, wherein said expansion plug includes a separate gas check member whose diameter is conformed to the diameter of the end of said projectile remote from the nose and the rifling of the barrel from which the projectile body is to be fired.

20. The muzzleloading firearm projectile according to claim 19, wherein said gas check member is made of a felt.

21. The muzzleloading firearm projectile according to claim 19, wherein said gas check member is made of a polymer.

* * * * *

UNITED STATES PATENT AND TRADEMARK OFFICE

CERTIFICATE OF CORRECTION

PATENT NO. : 7,380,505 B1
APPLICATION NO. : 11/646959
DATED : June 3, 2008
INVENTOR(S) : Jeffrey C. Shiery It is certified that error appears in the above-identified patent and that said Letters Patent is hereby corrected as shown below:

Column 9, line 45, change “annual” to --annular--.

Column 9, line 52, change “annual” to --annular--.

Signed and Sealed this

Twenty-fifth Day of November, 2008

JON W. DUDAS
*Director of the United States Patent and Trademark Office*